US005816899A

United States Patent [19]

Hart et al.

[11] Patent Number: 5,816,899

[45] Date of Patent: Oct. 6, 1998

[54] MICRO PRECISE POLISHING APPARATUS

[75] Inventors: Michael F. Hart, Mundelein; Scott D. Holt, Round Lake Beach, both of Ill.

[73] Assignee: Buehler, Ltd., Lake Bluff, Ill.

[21] Appl. No.: 681,018

[22] Filed: Jul. 22, 1996

[51] Int. Cl.[6] ..... B24B 41/06

[52] U.S. Cl. ..... 451/272; 269/71; 451/279; 451/366; 451/387; 451/405

[58] Field of Search ..... 451/41, 44, 212, 451/231, 232, 272, 278, 279, 366, 387, 396, 405; 269/58, 71, 43, 91, 92

[56] References Cited

U.S. PATENT DOCUMENTS

| | | | |
|---|---|---|---|
| 1,736,977 | 11/1929 | Liebl | 451/405 X |
| 3,815,289 | 6/1974 | Hoffman | 451/279 |
| 3,818,641 | 6/1974 | Long | 451/279 |
| 3,902,283 | 9/1975 | Bean | 451/279 X |
| 4,106,240 | 8/1978 | De Bartolo | 451/405 X |
| 4,517,770 | 5/1985 | Leibowitz | 451/279 |
| 4,536,992 | 8/1985 | Hennenfent et al. . | |
| 4,625,460 | 12/1986 | Burgess et al. . | |
| 5,272,844 | 12/1993 | Burgess et al. . | |

*Primary Examiner*—Timothy V. Eley
*Attorney, Agent, or Firm*—Banner & Witcoff Ltd.

[57] ABSTRACT

Apparatus and method for grinding semiconductor chips and other specimens prior to microscopic examination thereof by supporting a specimen on a specimen mount, fixing the specimen mount to a lower end of a lower arm, connecting an upper end of the lower arm to a swingable arm by a horizontal pivot which permits the lower arm and specimen mount to move upwardly and downwardly relative to the swingable arm, providing a stop to limit downward movement of the specimen mount relative to the swingable arm when the lower arm reaches a zero position, moving the swingable arm downwardly to lower the specimen to engage an underlying rotatable grinding platen to define a zero position, and continuing to move the swingable arm downwardly beyond the zero position by an amount corresponding to the amount of material to be removed from a lower portion of the specimen so that the stop will prevent removal of additional material.

24 Claims, 7 Drawing Sheets

FIG.4
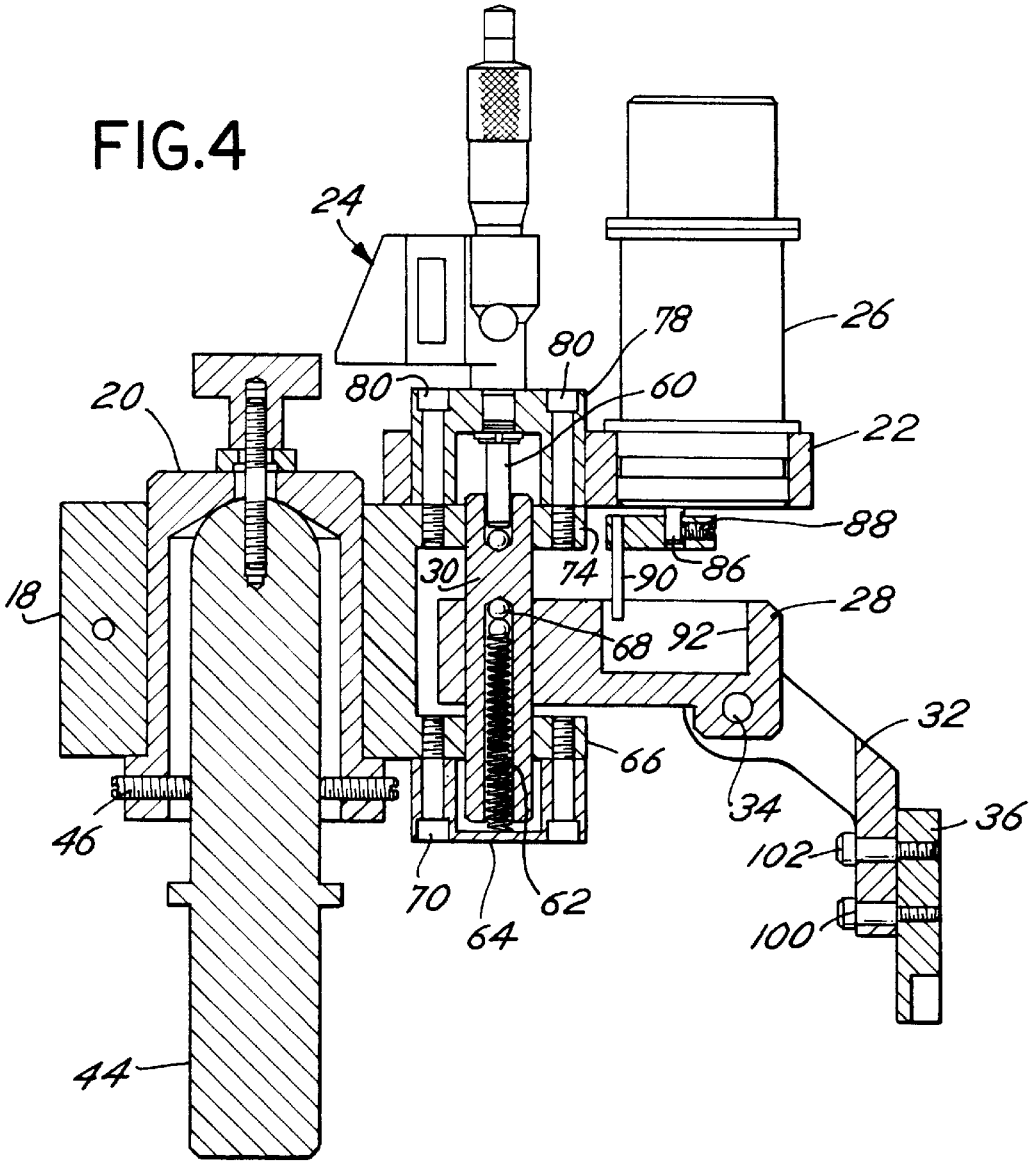
FIG.5
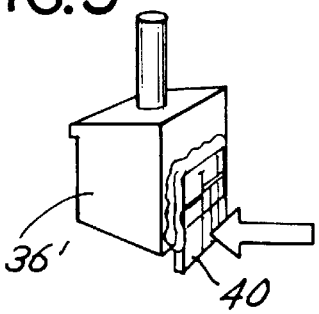
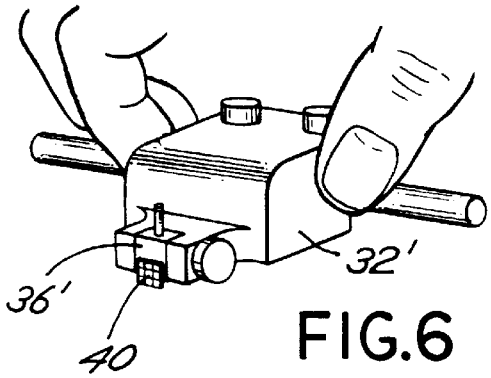
FIG.6

MICRO PRECISE POLISHING APPARATUS

BACKGROUND OF THE INVENTION

The present invention relates to a machine for grinding and polishing a specimen prior to microscopic examination of the specimen. The invention is particularly suited for highly precise grinding and polishing of semiconductor chips prior to microscopic examination of such a chip.

In recent years, scientists and technicians have become increasingly interested in examining features of semiconductor chips which are smaller in terms of microns or even sub-microns, and it is necessary for an operator to measure the precise amount of material to be removed from the surface of a semiconductor chip in order to reach an area of interest for microscopic examination. In order to permit such examination of smaller and smaller areas, it is necessary to have a machine which will remove a precise amount of material from the surface of a semiconductor chip in order to reach the desired area.

It is an object of the present invention to provide a grinding and polishing machine which will remove a very precise amount of material from a specimen to be examined.

A further one of our objects is to provide a grinding and polishing machine which can be set to remove a given amount of material and will remove that amount of material with great accuracy, after which the material removal operation will stop automatically.

Still another of our objects is to provide a polishing and grinding machine which is capable of holding a specimen in a very precise orientation relative to a grinding and polishing platen.

The foregoing and other objects and advantages of our invention will be apparent from the following description of certain preferred embodiments thereof, taken in conjunction with the accompanying drawings.

DESCRIPTION OF THE DRAWINGS

FIG. 4 is an enlarged vertical sectional view showing certain components of FIG. 2 in assembled form;

FIG. 5 is a schematic, perspective view showing the manner in which a semiconductor chip may be glued to the side of a specimen holder so as to project downwardly therefrom for grinding and removing material from the projecting lower edge of the chip;

FIG. 6 is a schematic, perspective view showing how the specimen holder of FIG. 5 may be mounted on a polishing arm for a grinding and polishing operation;

Now, in order to acquaint those skilled in the art with the manner of making and using our invention, we shall describe, in conjunction with the accompanying drawings, certain preferred embodiments of our invention.

DETAILED DESCRIPTION OF THE INVENTION

Figure 1:
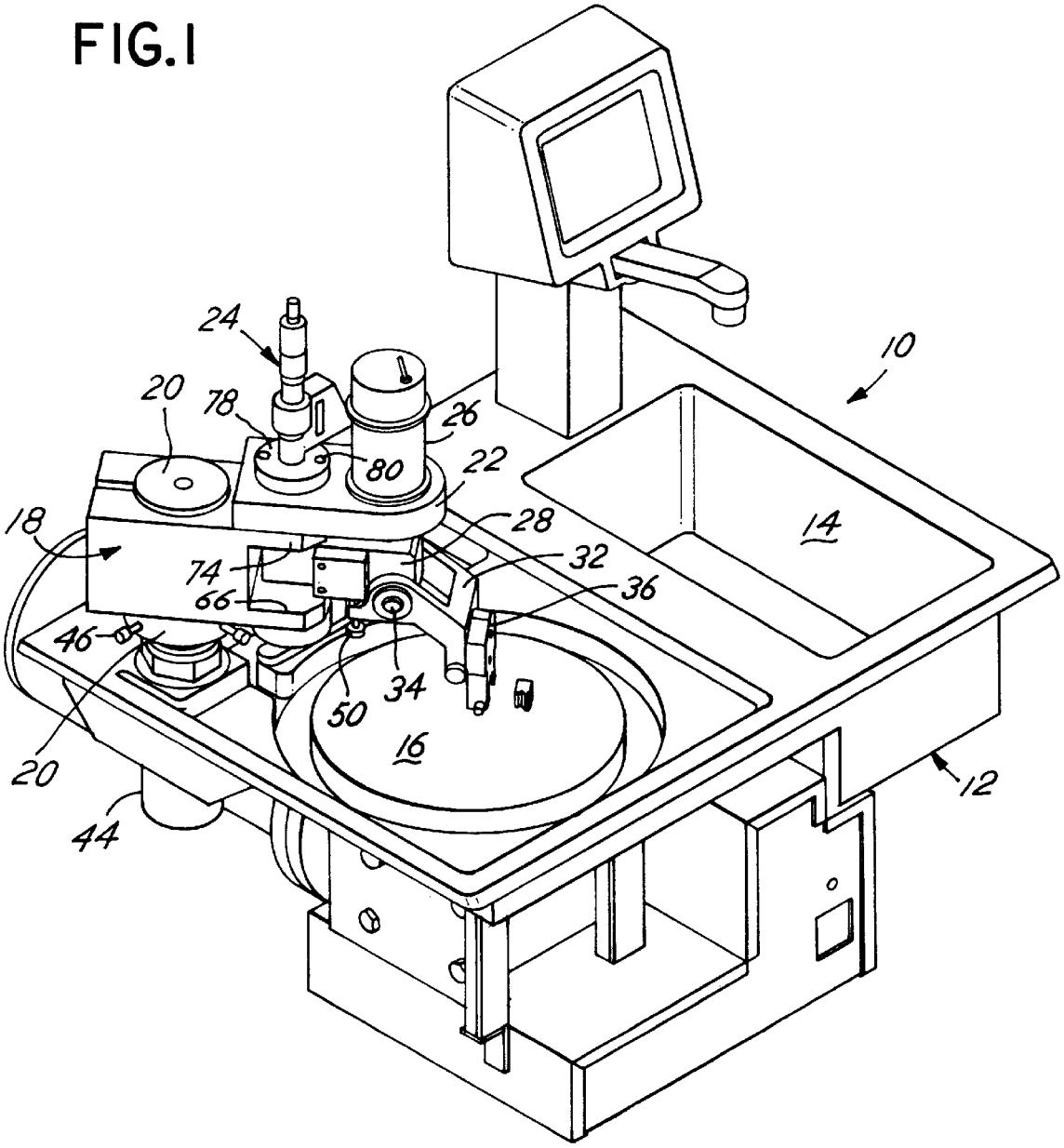
FIG. 1 is a perspective view of a semiconductor grinding apparatus constructed in accordance with the present invention.

FIG. 1 shows a grinding and polishing machine 10 having a cast frame 12 which includes a wash tank 14 and a rotatable platen 16. The platen 16 is rotatable about a central vertical axis as is known in the art. Because of the precision nature of the grinding machine of the present invention, the surface of the platen 16 is ground with substantial accuracy to a flat surface. As is known in the art, a diamond impregnated thin film or sheet of paper may be mounted on the top of the platen to provide an abrasive or polishing surface for removing material from a specimen.

A main body 18 is supported on a floating mount 20. The main body 18 has a motor mounting plate 22 pivotally mounted on its upper surface. A micrometer 24 is mounted on top of an upper cap 78 as shown in FIGS. 1 and 4, and a gear motor and cover assembly 26 is mounted on the mounting plate 22.

A swing arm 28 fixedly mounted on a vertical pivot pin 30 (see FIG. 4) and a lower arm 32 is carried on a horizontal pivot pin 34 which is supported from the swing arm 28. As shown in FIGS. 1 and 4, a specimen mount 36 is fixedly mounted to a vertical surface of the lower arm 32 for the purpose of holding a specimen such as a semiconductor chip which is to be ground or polished by being held against the top surface of the rotatable platen 16.

FIG. 5 is a schematic, perspective view showing a specimen mount 36', having a semiconductor chip 40 glued to the side of the mount with the lower edge projecting downwardly for the purpose of engagement against the surface of a rotating platen so that a desired amount of material may be removed from the projecting lower edge of the chip. FIG. 6 is a further schematic perspective view showing the mount 36', held on an arm 32', for the purpose of holding the lower edge of the chip 40 against the surface of a rotatable platen. The foregoing schematic drawings illustrate the manner in which a semiconductor chip may be fixed to the specimen mount shown at 36 in FIGS. 1 and 4.

Figure 2:
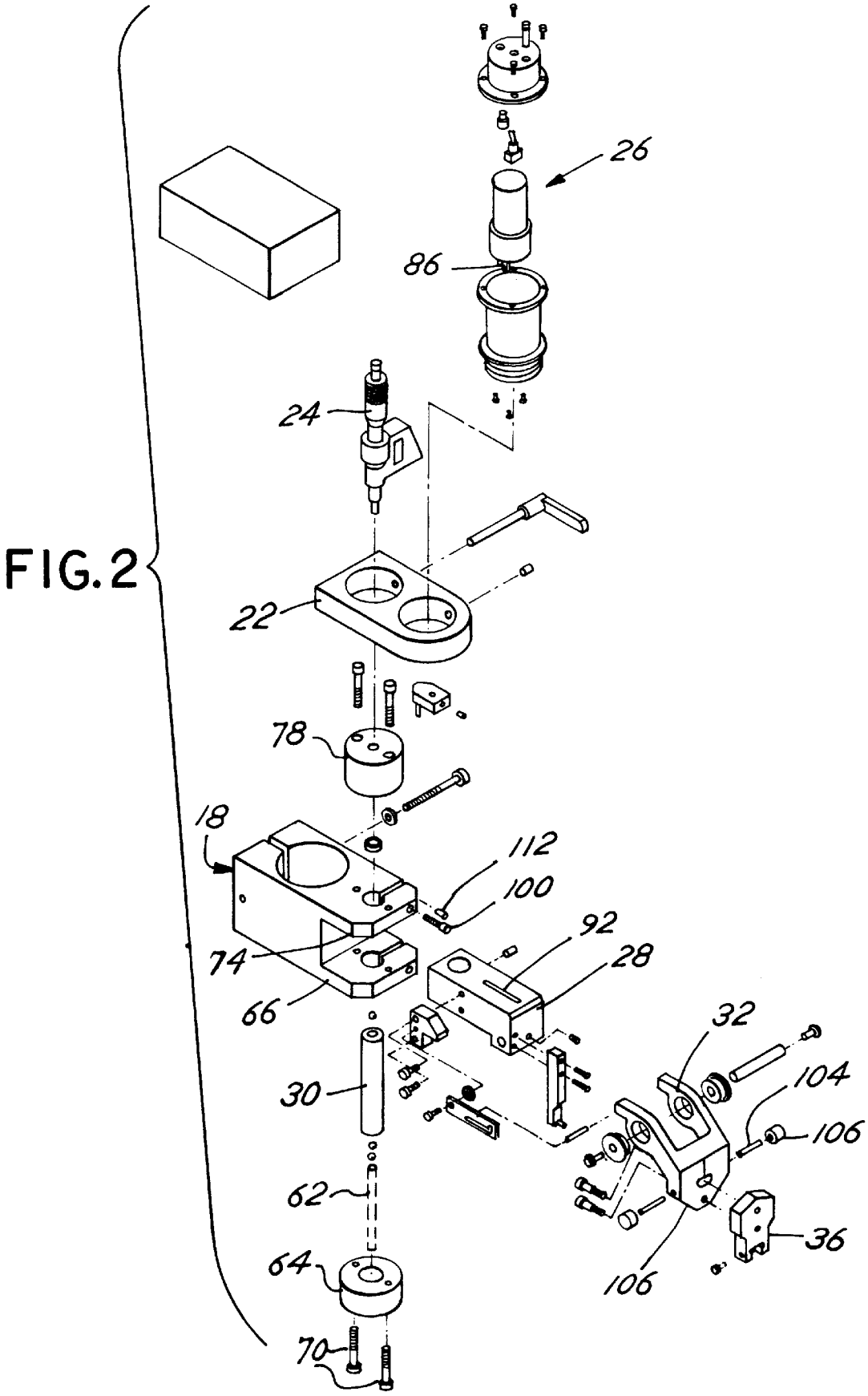
FIG. 2 is an exploded, perspective view of the principal components of the apparatus of FIG. 1.

FIG. 4 shows the sample pivot mount 36 which is attached to a vertical face of the lower arm 32 by a lower bolt 100 which permits the sample mount 36 to pivot relative to the lower arm 32. An upper bolt 102 extends through a generally horizontal slot (not shown) in the vertical portion of the lower arm 32 and it threads into the sample mount 36. Accordingly, the upper bolt 102 can move from side-to-side as the sample mount 36 is pivoted about the lower bolt 100. Also, while not shown in FIG. 4, FIG. 2 shows a threaded rod 104 and a knob 106, and similar members are shown on both sides of the lower arm 32. By backing off one of the two rods 104 and advancing the opposite rod 104, an operator can adjust and fix the pivotal position of the sample mount 36 about the bolt 100.

In order for an operator to know the desired pivotal position of the sample mount 36, the operator may test the arrangement by grinding some material off the bottom of the sample which is affixed to the sample mount as shown in FIGS. 5 and 6. Thereafter, the sample may be viewed under a microscope to check the angle of the bottom surface, and thereafter the operator may adjust the pivotal position of the sample mount 36 as desired.

Figure 3:
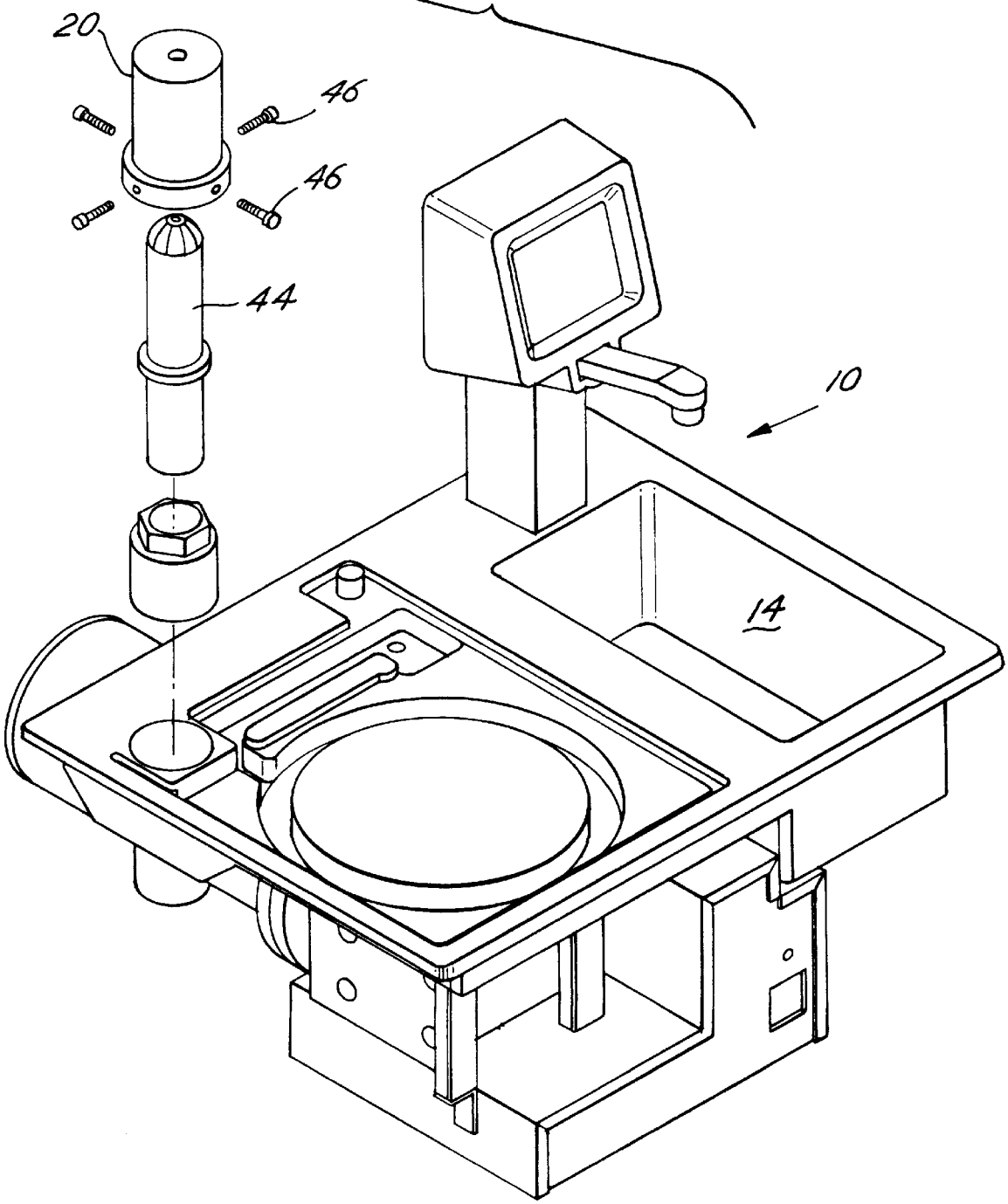
FIG. 3 is a partially exploded, perspective view of selected components of the apparatus of FIG. 1.

It is important that a specimen be accurately held relative to the surface of the polishing platen 16 so that the bottom of the specimen to be polished is parallel to the surface of the platen 16. In order to achieve such orientation of the specimen, FIG. 4 shows the floating mount 20 mounted on a post 44, and four circumferentially spaced screws 46 (see FIGS. 3 and 4). By adjusting the four screws 46, an operator can adjust the orientation of the floating mount 20 and in that manner adjust the orientation of the main body 18 and the swing arm 28 together with the specimen mount 36. The foregoing adjustment need only be made once when setting up the machine and need not be repeated.

In accordance with the present invention, precise vertical adjustment of the lower arm 32 may be made which in turn controls the position of the specimen relative to the platen 16. Referring to FIG. 1, as previously noted, the lower arm 32 is carried from swing arm 28 by a horizontal pivot pin 34. In the foregoing manner, the lower arm 32 may pivot freely about pivot pin 34 relative to the swing arm 28. In addition, FIG. 1 shows an adjustable screw 50 which is threaded up through a rearend portion of the lower arm 32 for engagement against the underside of the swing arm 28. In the foregoing manner, the adjustable screw 50 acts as a stop to limit the clockwise movement of the lower arm 32 relative to the swing arm 28.

The sectional view of FIG. 4 does not show the adjusting screw 50 of FIG. 1. Moreover, other types of stop means may be used, and such a screw is not necessary, but it is necessary to limit the amount by which the lower arm shown at 32 in FIG. 1 may swing down about pin 34 in order to control the amount of material removed from a specimen being held in the mount 36.

It is a feature of the present invention to adjust in a very precise manner the vertical position of the swing arm 28 relative to the polishing platen 16 at the beginning of a polishing operation. The swing arm 28 is adjusted to a vertical position which causes the specimen 40 (see FIGS. 5 and 6) held in the mount 36 to engage the top surface of platen 16 and, through such engagement, to cause lower arm 32 to move upwardly or in a counterclockwise direction about pivot pin 34 so as to move the adjusting screw or stop 50 away from the underside of the swing arm 28 by a precisely controlled amount.

Thereafter, during a polishing operation, as material is removed from the bottom of a specimen 40 held in specimen mount 36, the lower arm 32 will gradually move down or in a clockwise direction about pivot pin 34 until the adjusting screw or stop 50 engages the underside of the swing arm 28. When such engagement occurs, it will not be possible for the lower arm 32 and specimen mount 36 to move further downwardly or in a clockwise direction about pivot pin 34, and as a result, no further material will be removed from the bottom of the specimen.

The foregoing mechanism and procedure enables an operator to precisely set the vertical position of the swing arm 28 relative to platen 30 at the beginning of a polishing operation, and in that way precisely control the amount of material to be removed from a specimen, after which the removal of such material will automatically stop. The mechanism for adjusting the vertical position of swing arm 28 will now be described.

FIG. 4 shows the shaft 30 which functions as a vertical pivot pin (as will be described later) and which is movable vertically. The shaft 30 is fixed to the swing arm 28 for conjoint vertical movement therewith. Accordingly, vertical adjustment of the position of shaft 30 will control the vertical position of swing arm 28, lower arm 32, and specimen mount 36.

FIG. 4 shows the micrometer 24 having a micrometer shaft 60 which is adjustable up and down by operation of the micrometer as is known in the art. The lower end of the micrometer shaft 60 enters into a bore in the upper end of vertical pivot pin 30 and engages a ball therein so as to be able to push down on pin 30. A spring 62 is positioned to extend upwardly into a bore in the underside of pin 30, and the spring is held in position by a lower cap 64 which is fixed to a lower bifurcated portion 66 of main body 18 by fastening screws 70. The upper end of spring 62 engages against one or more balls 68 positioned in the bore at the upper end of the spring.

When micrometer 24 is operated to move micrometer shaft 60 downwardly, the vertical pivot pin 30 is moved downwardly against the force of spring 62 and carries with it swing arm 28 thereby moving lower arm 32 and sample mount 36 downwardly by a precise amount controlled by micrometer 24. Similarly, when micrometer 24 is operated to move micrometer shaft 60 upwardly, spring 62 will move vertical pivot pin 30 upwardly thereby raising swing arm 28, lower arm 32 and sample mount 36 by a precise amount controlled by the micrometer 24.

Therefore, the sample mount 36 and a sample 40 held therein may be adjusted vertically in a precise manner to control the amount of material removed from a specimen during a polishing operation. It can be seen in FIG. 4 that the right hand end of the main body 18 includes the lower bifurcated portion 66 and an upper bifurcated portion 74, and the vertical space between portions 66 and 74 substantially exceeds the thickness of swing arm 28 so as to permit the necessary vertical adjustment of such spring arm. An upper cap 78 is secured to the upper bifurcated portion 74 of main body 18 by screws 80 for the purpose of mounting micrometer 24 on the main body 18.

Figure 7:
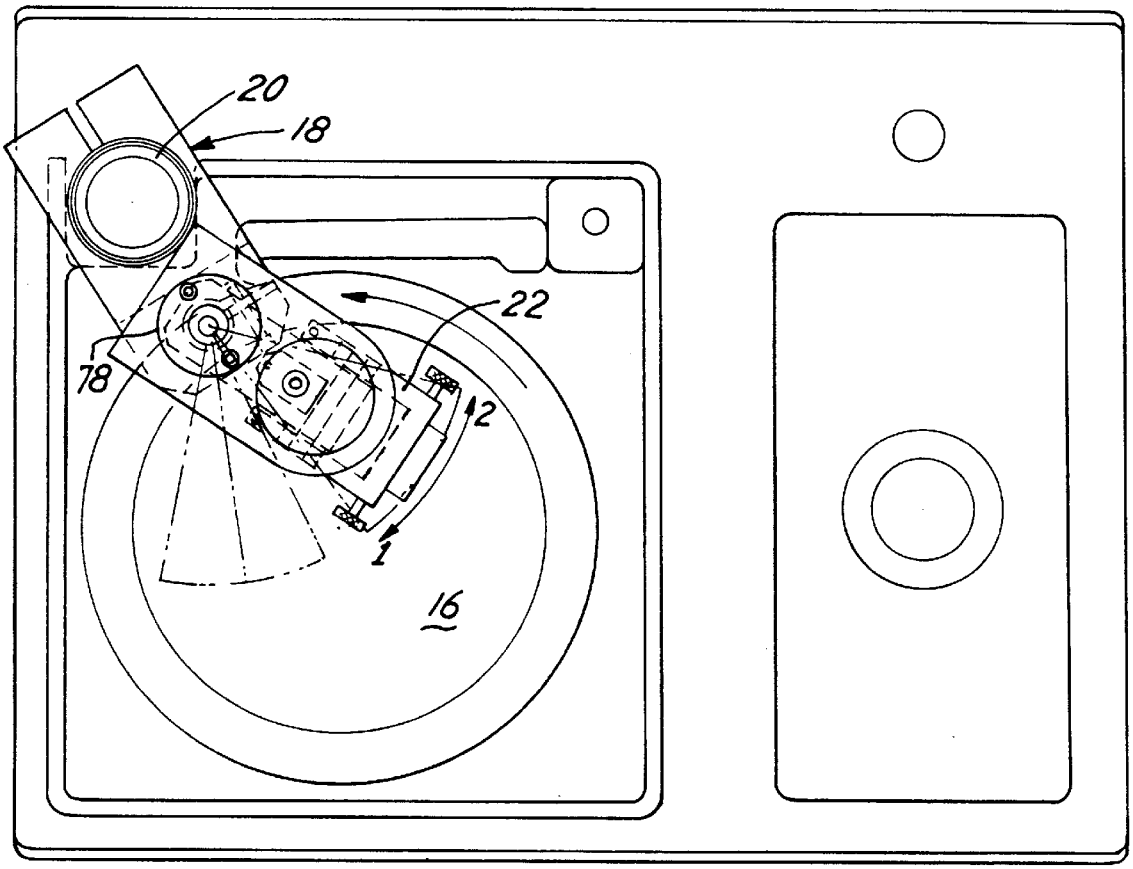
FIG. 7 is a top plan schematic view showing the range or angle through which a specimen holding arm may move about a vertical axis during a polishing operation so as to move the specimen back and forth across the surface of a rotating grinding platen.

In the polishing of a specimen which is held in the specimen mount 36 and positioned in engagement with the top of rotatable platen 16, it is desirable to swing the arm 28 about the axis of pivot pin 30 to which it is fixed in order to swing a specimen in a direction generally perpendicular to the rotating motion of the platen 16. By way of example, FIG. 7 is a top plan view showing a platen 16 which rotates in a counterclockwise direction. An arc is shown extending between a position 1 and a position 2. Those two positions represent the extreme inward and outward positions of a specimen as the same is swung in an arcuate path which is generally perpendicular to the rotating movement of the platen 16. The general purpose of swinging the specimen in the foregoing manner is to utilize the entire polishing surface of the platen 16.

The mechanism for moving swing arm 28 about the vertical axis of pivot pin 30 will now be described in connection with FIGS. 1, 2 and 4. The gear motor and cover assembly 26 includes a gear motor which drives a shaft 86 which is connected by an eccentric link 88 to a crank pin 90. The lower end of crank pin 90 projects into a slot 92 in swing arm 28 as best shown in FIGS. 2 and 4. Accordingly, the gear motor will drive shaft 86 to drive crank pin 90 and in that manner cause swing arm 28 to oscillate back and forth about the axis of vertical pivot pin 30 to which the swing arm is fixed. During such movement, crank pin 90 will move back and forth in slot 92. The magnitude of such oscillation is controlled so that, as shown in FIG. 7, a specimen will oscillate back and forth between positions 1 and 2 during a polishing operation.

Referring again to the use of the micrometer 24 to control the amount of material removed, as an operator uses the micrometer to lower swing arm 28, the specimen 40 first touches the polishing surface of the platen 16, and that position is in effect a zero position. That is the position the mechanism will be in when the polishing or material removal operation is completed. Therefore, as the operator continues to move the swing arm 28 down from the foregoing zero position, that amount of additional downward movement corresponds to the amount of material which will be removed. In accordance with one preferred embodiment, an operator may use a known type of micrometer which has a zero button, meaning the operator may press the button and produce a zero reading on the micrometer. Once that is done, further operation of the micrometer to lower swing arm 28 from the zero position will produce a reading on the micrometer equal to the amount of material which will be removed.

As indicated previously, any type of stop could be used in place of the adjustable screw shown at 50 in FIG. 1. Moreover, a switch could be used in that position to produce a signal when the predetermined amount of material has been completely removed.

As previously explained, the main body 18 has a right-hand end which is bifurcated to provide an upper section 74 and a lower section 66 as best shown in FIG. 4. FIG. 4 further shows the manner in which the vertical pivot pin 30 is journalled with its upper end passing through a hole in main body section 74 and its lower end passing through a hole in the main body section 66, the pin 30 being vertically movable relative to the main body as previously described.

It is important to properly journal the vertical pivot pin 30 in the main body sections 66 and 74 in order to permit relative vertical and rotational movement of the pin 30 while at the same time providing precise control of the vertical orientation of the pin. FIG. 2 shows the bifurcated sections 66 and 74 of the main body, and each such section includes a slot in communication with the hole in which the pin 30 is journaled. Such slots permit the use of screws to either close down a hole or open a hole so as to permit precise adjustment of the size of the holes which journal the vertical pivot pin 30. Such adjustments which can be made both on the lower section 66 and the upper section 74 will permit precise control of the clearance between the pivot pin 30 and the bifurcated sections of the main body.

It will be noted that the vertical pivot pin 30 not only moves up and down but also pivots about a vertical axis because it is fixed to the swing arm 28 which is oscillated back and forth as previously described. It is important to achieve optimum results with the present invention to effect precise control of the foregoing holes in the main body sections 66 and 74. It is important that the vertical pivot pin 30 be maintained perpendicular to the top surface of the polishing platen 16, and the foregoing adjustable pins shown at 36 in FIGS. 3 and 4 permit such precise control of pin 30.

The upright vertical pivot pin 30 must be able to both rotate in the holes in the upper and lower main body sections 74 and 66 in which it is journaled and also move vertically therein. At the same time, a minimum of slop or looseness is required for precision material removal. FIG. 2 shows an Allen cap screw 100 which threads right through the slot and into the structure behind the slot so that the screw 100 may be used to close down on the slot and reduce the size of the adjacent hole. Also, there is shown a set screw or jacking bolt 112 which threads into the threaded hole and engages against the structure behind the slot so as to open the slot and enlarge the size of the hole in which pin 30 is journalled. A similar cap screw and jacking bolt are provided for adjusting the hole in the lower bifurcated body section 66.

Referring now to FIG. 7, the motor mounting plate 22 is shown in its counterclockwise position where a rear corner of the plate engages the upper end of floating mount 20 which functions as a stop. When motor mounting plate 22 is in the foregoing counterclockwise position, the sample will be oscillated between positions 1 and 2 as previously described. Because the platen is rotated in a counterclockwise direction, the force exerted by the platen on the sample will be generally toward the floating mount 20. However, when the motor mounting plate is rotated about upper cap 78 to a clockwise position as represented in dotted lines in FIG. 7, the force exerted by the platen on the sample will be in the opposite direction.

As best shown in FIG. 4, the motor mounting plate 22 is mounted on top of the bifurcated section 74 of the main body 18 and it is mounted around the upper cap 78. The plate 22 can be manually pivoted around the upper cap 78 between two different operational positions. One such position is shown where the plate 22 is in its counterclockwise position and, because the platen 16 is rotatable in a counterclockwise direction, the force exerted by the platen on the sample is generally toward the floating mount 20 as previously described. Looking at FIG. 4, it will be understood that such a force will cause the lower arm 32 to pivot downwardly or clockwise about pivot 34 thereby increasing the vertical force between the sample and the polishing platen 16.

Referring again to FIG. 7, if the motor mounting plate 22 is manually pivoted clockwise to its other position shown in FIG. 7, the force induced by the platen 16 on the sample will be in the opposite direction or to the right as viewed in FIG. 4. In the latter situation, the force induced by the platen 16 will reduce the vertical force between the sample and the platen.

One desirable procedure is to position the mounting plate 22 in its counterclockwise position as shown in FIG. 7 for a grinding operation, and to position it in its clockwise position as shown in FIG. 7 for a polishing operation. Referring again to FIG. 7, a horizontal set screw (not shown) may be threaded through the side of the motor mounting plate 22 to engage the periphery of the upper cap 78 in order to fix the plate 22 in a given position and release the same for manual movement to the opposite position as described above.

Having in mind the foregoing explanation of the force which the rotating platen 16 applies to the specimen during a grinding or polishing operation, such a force has a definite effect on the vertical force component between the specimen and the platen during a grinding or polishing operation. For example, assuming the specimen is being ground and the motor mounting plate 22 is in the position shown in FIG. 7, reference to FIG. 4 will indicate that the platen will exert a horizontal force to the left on the sample (not shown) which will induce a downward vertical force component between the sample and the platen 16 because the horizontal force will tend to pivot the lower arm 32 in a clockwise direction about pivot 34. Moreover, the magnitude of the induced vertical force will increased as the lever arm or distance between the platen 16 and the pivot 34 increases.

The foregoing is a reason for providing a second embodiment to be described hereinbelow where the lever arm is reduced to a minimum in order to minimize any force induced by the rotating platen and thereby make it easier to control the force between the specimen and the rotating platen during a polishing or grinding operation.

Still referring to FIG. 4, in addition to a vertical force component induced by the force of the rotating platen 16 on the specimen, the weight of the lower arm 32 and the specimen mount 36 and specimen create an added gravitational force to create a clockwise moment about the pivot 34 so as to produce an additional downward force component causing the specimen to be pressed down against the rotating platen 16.

Figure 8:
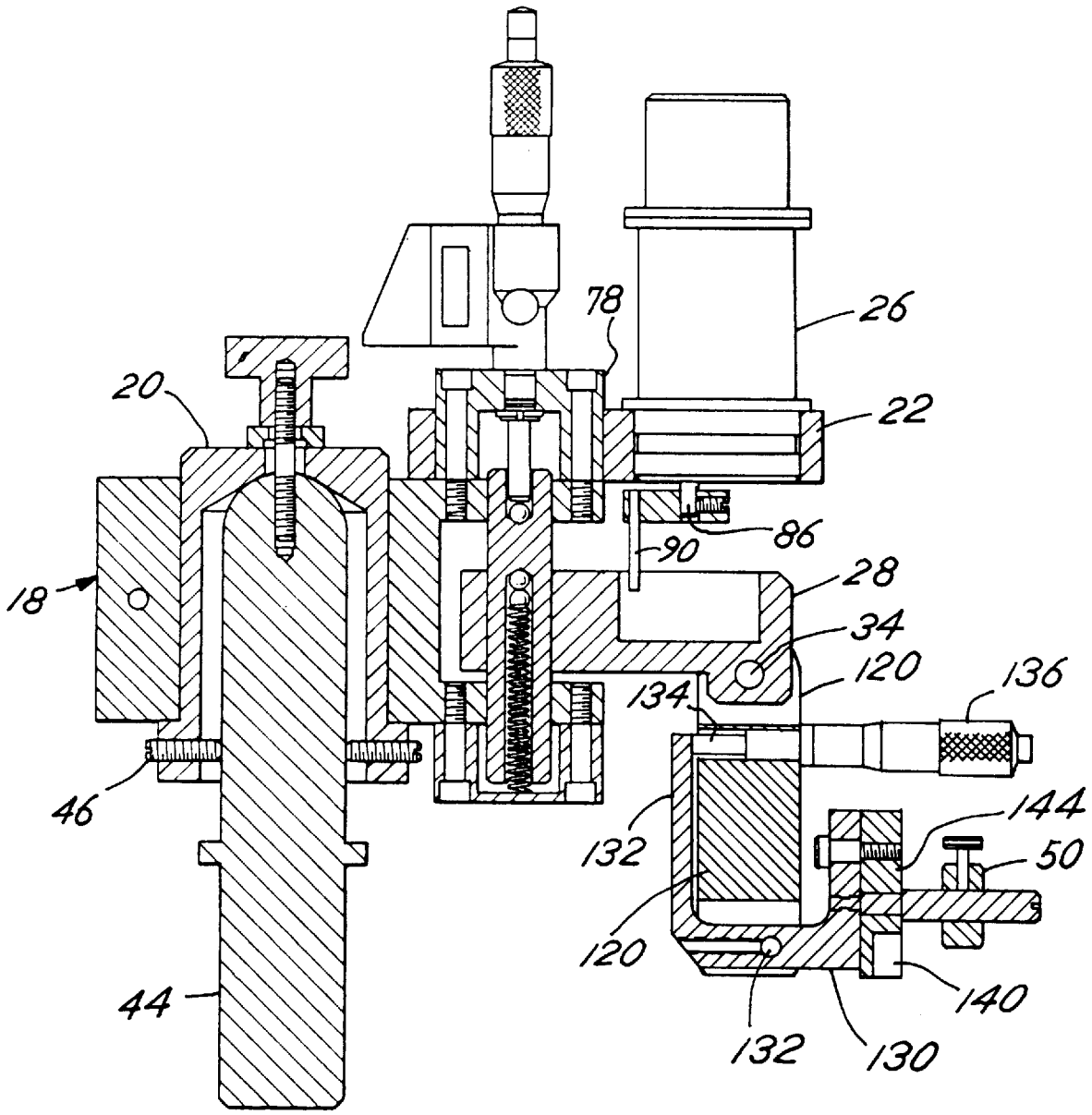
FIG. 8 is an enlarged vertical sectional view similar to FIG. 4 but showing an alternative embodiment of the invention.
Figure 9:
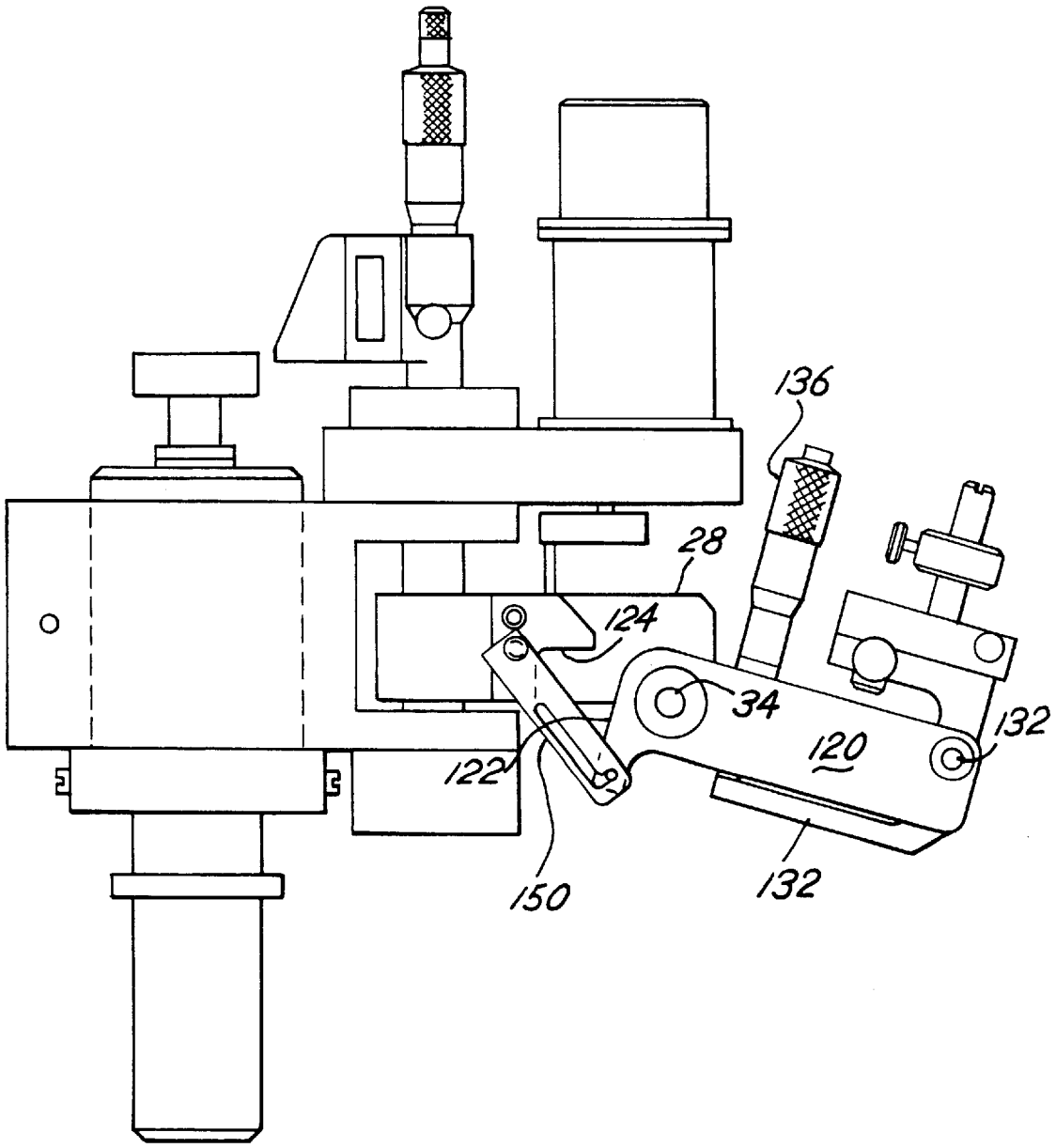
FIG. 9 is a side elevational view of the embodiment of FIG. 8.

Reference is now made to FIGS. 8 and 9 which illustrate a second embodiment of the invention which has the advantage of affording greater control over the vertical force component between a specimen and the top surface of the grinding and polishing platen 16. The structure shown in FIGS. 8 and 9 is the same as the prior embodiment and the same reference numerals will be used, except for the components suspended from the horizontal pivot pin 34.

FIGS. 8 and 9 show a lower arm 120 pivotally carried on the horizontal pivot pin 34. FIG. 8 shows the arm 120 in its extreme clockwise position where surface 122 on the arm 120 engages a stop surface 124 on the swing arm 28 (see FIG. 9) so as to prevent further clockwise movement of arm 28 about pin 34 after arm 28 has reached its maximum clockwise position as shown in FIG. 8.

A floating arm 130 is suspended from lower arm 120 in a pivotal manner by a horizontal pivot pin 132, and in FIG. 8 the floating arm 130 is shown in its extreme clockwise position where a plate portion 132 thereof is engaged against the end of a micrometer shaft 134 of a second micrometer 136. The micrometer 136 could be replaced by a set screw or the like which could also act as a stop for the plate portion 132 of floating arm 130. However, the use of micrometer 136 will afford increased accuracy.

As shown in FIG. 8, when the arm 120 is in its extreme clockwise position, and the floating arm 130 is in its extreme clockwise position, the structure is positioned for a grinding operation, and a sample mount is fixed in the area shown at 140 in the manner previously described. The sample (not shown) will project down so that its lower edge will engage the rotating platen 16 (not shown in FIGS. 8 and 9) for removing material therefrom.

Because the floating arm 130 which supports the sample mount 144 is pivotal about pivot pin 132, the force induced by the platen 16 is significantly reduced. In other words, in the second embodiment the lever arm is the distance from the lower end of a sample to the pivot 132, rather than to the pivot pin 34 as in the earlier embodiment. The result is that the vertical component of a force induced by the platen 16 as it engages the sample (not shown) is very small as compared to the earlier embodiment. As a result, only a minimal vertical force component between the sample and the platen 16 is induced by the rotating platen so that an operator can control such vertical force component by controlling the weight of the floating arm 130 and the structure supported therefrom, which may include an adjustable weight as shown at 50 in FIG. 8.

Still referring to FIG. 8, the swing arm 28 may be lowered a precise amount as described earlier herein, and as the arm 28 is lowered from the zero position shown in FIG. 8, the floating arm 130 will rotate in a counterclockwise position from the position shown in FIG. 8 causing the plate portion 132 to separate from the end of the micrometer shaft 134. The amount of such separation will define the amount of material to be removed from a specimen, just as in the prior embodiment. During a polishing operation, as the sample gradually moves downwardly due to removal of material, the floating arm 130 will pivot clockwise until it reaches the zero or limiting position shown in FIG. 8, after which no additional material will be removed from the sample.

If one wished to totally eliminate the effect of the rotating platen 16 on inducing a vertical force component between a sample and the platen 16, it would be necessary to locate the pivot pin 34 in the first embodiment, or the pivot pin 132 of the second embodiment, in the plane of the top surface of the platen. In the embodiment shown in FIG. 8, the pivot pin 132 is located quite close to the plane of the top surface of platen 16 so as to minimize the effect of a force induced by the rotating platen 16. It is therefore easier to control with precision the magnitude of the vertical force component between a specimen and the top surface of platen 16.

FIG. 9 shows the floating arm 120 pivoted counterclockwise to a raised position in which it is held by a link 150. It is necessary to be able to raise the arm 120 and associated components to an elevated position when removing or mounting a specimen to the mount 144 or when changing an abrasive sheet on the top surface of the platen 16.

We claim:

1. A grinding and polishing apparatus for precision removal of material from a specimen comprising, a sample mount to which a specimen is affixed for holding said specimen in contact with a rotatable platen;

an arm member, cooperatively associated with said sample mount and capable of vertical and horizontal positioning of said sample mount by a vertical pivot, so that when said arm member is lowered to bring said specimen in contact with said rotatable platen, said sample mount will move generally upwardly relative to said arm member;

means for raising and lowering said arm member; and a stop means associated with said arm member and positioned to effect stopping of said generally downward movement of said sample mount in a zero position relative to said arm member when there is no vertical force component between said specimen and said rotatable platen while permitting generally upward movement of said sample mount relative to said arm member from said zero position.

2. The precision grinding and polishing apparatus in claim 1 wherein said sample mount has a horizontal pivot point allowing said sample mount to pivot relative to said arm member and adapted to effect the upward and downward movement of said sample mount relative to said arm member.

3. The precision grinding and polishing apparatus in claim 1 wherein said arm member has a means for horizontal movement about a vertical pivot so as to oscillate said sample mount relative to said rotatable platen during a grinding or polishing operation.

4. The precision grinding and polishing apparatus in claim 3 wherein said vertical pivot comprises, a vertical pivot point, affixed to said arm member, allowing upward and downward movement of said arm member; and means for moving said vertical pivot point downwardly and upwardly.

5. The precision grinding and polishing apparatus in claim 4 controlling said upward and downward movement of said vertical pivot point is accomplished with a micrometer.

6. The precision grinding and polishing apparatus in claim 4 wherein said vertical pivot point is supported from a main body for vertical and pivotal movement, said main body being mounted around a floating mount which in turn is supported around a fixed post and is positionable by use of an adjustable means for positioning said floating mount relative to said post and adjusting the position of said main body.

7. A grinding and polishing apparatus for precision removal of material from a specimen comprising, a sample mount to which a specimen is affixed for holding said specimen in contact with a rotatable platen;

a movable swing arm capable of vertical and horizontal positioning of said sample mount by a vertical pivot, pivotally connected to said sample mount by a horizontal pivot, said sample mount being pivotal about said horizontal pivot to raise and lower said sample mount relative to said movable swing arm, so that when said movable swing arm is lowered to bring said specimen in contact with said rotatable platen, said sample mount will move generally upwardly relative to said movable swing arm;

means for raising and lowering said movable swing arm to control the position of said sample mount relative to said movable swing arm when said specimen is engaged with said rotatable platen; and stop means associated with said sample mount and positioned to effect stopping of said generally downward movement of said sample mount in a zero position relative to said movable swing arm when there is no vertical force component between said specimen and said platen while permitting generally upward movement of said sample mount relative to said movable swing arm from said zero position.

8. The grinding and polishing apparatus in claim 7 wherein said movable swing arm is pivotally connected for oscillating movement back and forth about said vertical pivot at an end generally opposite said horizontal pivot.

9. The grinding and polishing apparatus in claim 8 including a motor and eccentric crank pin for oscillating said movable swing arm about said vertical pivot, said crank pin engaged with said movable swing arm.

10. The grinding and polishing apparatus in claim 7 wherein said stop means is fixed relative to said sample mount and is positioned to engage said movable swing arm to prevent further downward movement of said sample mount relative to said movable swing arm when said sample mount reaches said zero position.

11. The grinding and polishing apparatus in claim 7 wherein said vertical pivot comprises, a vertical pivot point which is affixed to said movable swing arm; and said means for raising and lowering said movable swing arm comprises means for moving said vertical pivot point downwardly and upwardly.

12. The grinding and polishing apparatus in claim 11 wherein said means for controlling movement of said vertical pivot point includes a micrometer positioned to move said vertical pivot point downwardly.

13. The grinding and polishing apparatus in claim 12 wherein said means for moving said vertical pivot point further includes a spring for moving said vertical pivot point upwardly to an extent permitted by said micrometer.

14. The grinding and polishing apparatus in claim 13 wherein said vertical pivot point is supported from a main body for vertical and pivotal movement, said main body being mounted around a floating mount which in turn is mounted around a fixed post and is positionable by an adjustable means for positioning said floating mount relative to said post and adjusting the position of said main body.

15. A grinding and polishing apparatus for precision removal of material from a specimen comprising, a sample mount to which a specimen is affixed for holding said specimen in contact with a rotatable platen;

a lower arm to which said sample mount is affixed;

a swing arm, pivotally connected to said lower arm by a horizontal pivot, said swing arm capable of vertical and horizontal movement and horizontally pivotal about a vertical axis, said lower arm being pivotal about said horizontal pivot to raise and lower said sample mount relative to said swing arm, so that when said swing arm is lowered to bring said specimen in contact with said rotatable platen, said lower arm and said sample mount will move generally upwardly relative to said swing arm, an amount of material is removed from said specimen approximately determined by the vertical distance traveled by said swing arm subsequent to said specimen contacting said rotatable platen;

a vertical pivot point aligned with said vertical axis and being fixed to said swing arm for conjoint vertical and horizontal pivotal movement therewith;

means for moving said vertical pivot point downwardly and upwardly to control the position of said lower arm and said sample mount relative to said swing arm when said specimen is engaged with said rotatable platen; and stop means associated with said lower arm and positioned to effect stopping of said generally downward movement of said lower arm in a zero position relative to said swing arm when there is no vertical force component between said specimen and said platen while permitting generally upward movement of said lower arm and said sample mount relative to said swing arm from said zero position.

16. The grinding and polishing apparatus in claim 15 wherein said swing arm is adapted to effect horizontal movement about said vertical pivot point about said vertical axis so as to oscillate said sample mount relative to said rotatable platen during a grinding or polishing operation, and motor means for providing said horizontal movement of said swing arm about said vertical axis.

17. The grinding and polishing apparatus in claim 16 wherein said means for moving said vertical pivot point downwardly and upwardly includes a micrometer for moving said vertical pivot point downwardly.

18. The grinding and polishing apparatus in claim 17 wherein said vertical pivot point is supported from a main body for vertical and horizontal pivotal movement, said main body being mounted around a floating mount which in turn is supported around a fixed post and is positionable by use of an adjustable means for positioning said floating mount relative to said post and adjusting the position of said main body.

19. A grinding and polishing apparatus for precision removal of material from a specimen comprising, a sample mount to which a specimen is affixed for holding said specimen in contact with a rotatable platen;

a floating arm to which said sample mount is affixed;

said floating arm being pivotally connected by a first horizontal pivot pin to a lower arm adjacent to a lower end of said lower arm;

said lower arm being connected adjacent an upper end to a vertically movable swing arm by a second horizontal pivot pin;

said lower arm being pivotal about said second horizontal pivot pin but being held rigid relative to said swing arm during a grinding or polishing operation;

said floating arm being pivotal about said first horizontal pivot to raise and lower said sample mount relative to said swing arm and said lower arm so that when said swing arm is lowered bringing said specimen in contact with said rotatable platen, said floating arm and said sample mount will move generally upwardly relative to said swing arm and said lower arm, an amount of material is removed from said specimen approximately determined by the vertical distance traveled by said swing arm subsequent to said specimen contacting said rotatable platen;

means for moving said swing arm downwardly and upwardly to control the position of said floating arm and said sample mount relative to said swing arm and said lower arm when said specimen is engaged with said rotatable platen; and stop means associated with said floating arm and positioned to effect stopping of said generally downward movement of said floating arm in a zero position relative to said lower arm when there is no vertical force component between said specimen and said platen while permitting generally upwardly movement of said floating arm and said sample mount relative to said lower arm and said swing arm from said zero position.

20. The grinding and polishing apparatus in claim 19 wherein said swing arm is mounted for oscillating movement back and forth about a vertical pivot at an end generally opposite said second horizontal pivot.

21. The grinding and polishing apparatus in claim 20 including a motor and eccentric crank pin for oscillating said swing arm about said vertical pivot, said crank pin engaged with said swing arm.

22. The grinding and polishing apparatus in claim 20 wherein said vertical pivot comprises, a vertical pivot point which is affixed to said swing arm; and said means for moving said swing arm downwardly and upwardly comprises means for moving said vertical pivot point downwardly and upwardly.

23. The grinding and polishing apparatus in claim 22 wherein said means for controlling movement of said vertical pivot point includes a micrometer positioned to move said vertical pivot point downwardly.

24. The grinding and polishing apparatus in claim 19 wherein said stop means includes a first stop fixed relative to said floating arm and a second stop fixed relative to said lower arm whereby engagement of said first and second stops prevents further downward movement of said sample mount relative to said lower arm and said swing arm when said floating arm reaches said zero position.

* * * * *